United States Patent [19]

Nanjyo et al.

[11] 3,952,138

[45] Apr. 20, 1976

[54] POWER CONTROL SYSTEM FOR ELECTRIC ARC OR REFINING FURNACE ELECTRICALLY DIRECTLY COUPLED TO INDEPENDENT POWER GENERATING UNIT OR UNITS

[75] Inventors: Toshio Nanjyo, Yokohama; Shozo Yasukawa, Yokosuka, both of Japan

[73] Assignee: Ishikawajima-Harima Jukogyo Kabushiki Kaisha, Tokyo, Japan

[22] Filed: Oct. 16, 1974

[21] Appl. No.: 515,170

[30] Foreign Application Priority Data

May 2, 1974 Japan ..... 49-49344

[52] U.S. Cl. ..... 13/12; 219/134

[51] Int. Cl.[2] ..... H05B 7/144

[58] Field of Search ..... 13/12, 9; 219/133, 134; 322/7, 8, 37; 290/1 R, 1 A

[56] References Cited

UNITED STATES PATENTS 3,183,294 5/1965 Kasper ..... 13/12

3,743,752 7/1973 Furuhashi ..... 13/12

*Primary Examiner*—R. N. Envall, Jr.

*Attorney, Agent, or Firm*—Scrivener Parker Scrivener & Clarke

[57] ABSTRACT

A power control system is disclosed for an electric arc or refining furnace circuit to which is supplied power directly from an independent power generating unit or units installed independently of a publicly available power supply system or any other power generating unit. Depending upon the operating conditions of the furnace, the power supply is controlled by the suitable adjustment of the generator voltage or frequency or by the combination thereof based upon the relations $V = K.\Phi.n$ where $V$ = generator voltage, $K$ = constant, $\Phi$ = flux density and $n$ = operating speed of a prime mover mechanically coupled to each generator, and $f = p.n/60$ where $f$ = frequency, and $p$ = number of poles in each generator.

10 Claims, 6 Drawing Figures

Fig. 1
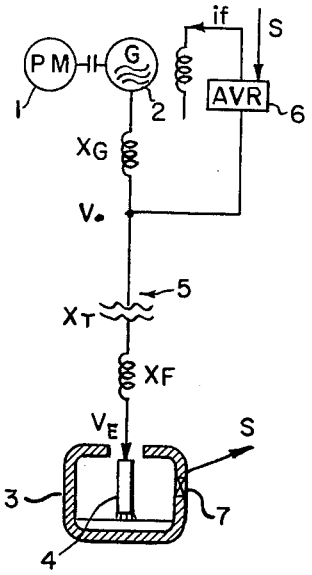
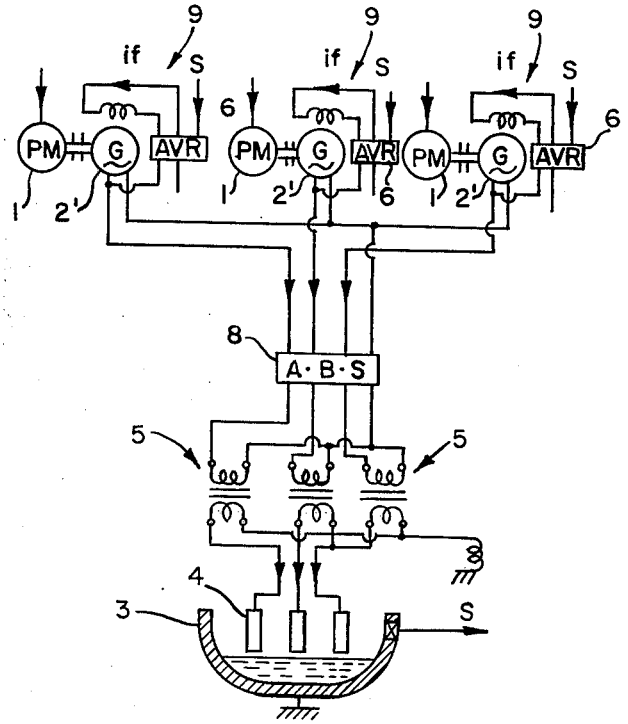
Fig. 2

Fig. 3
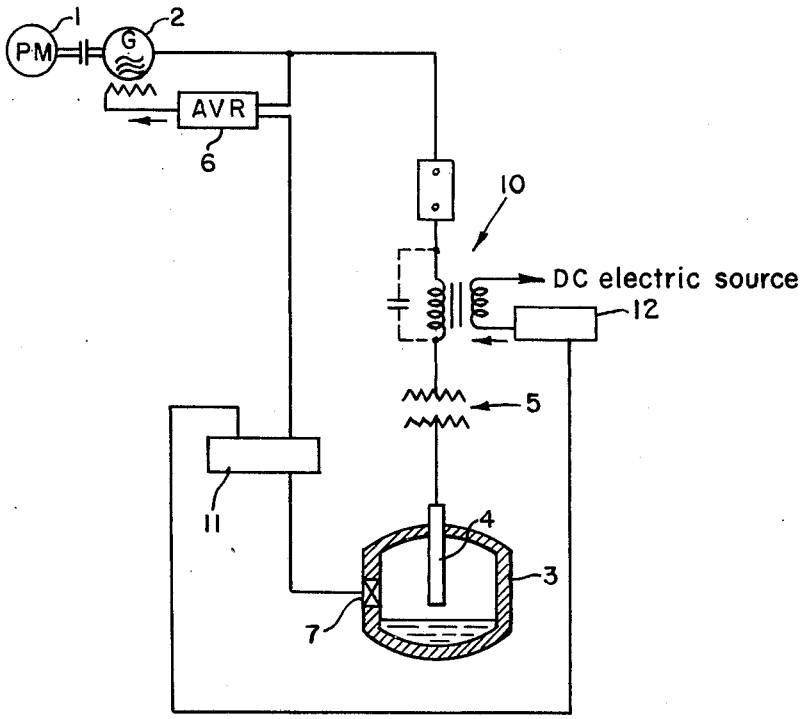
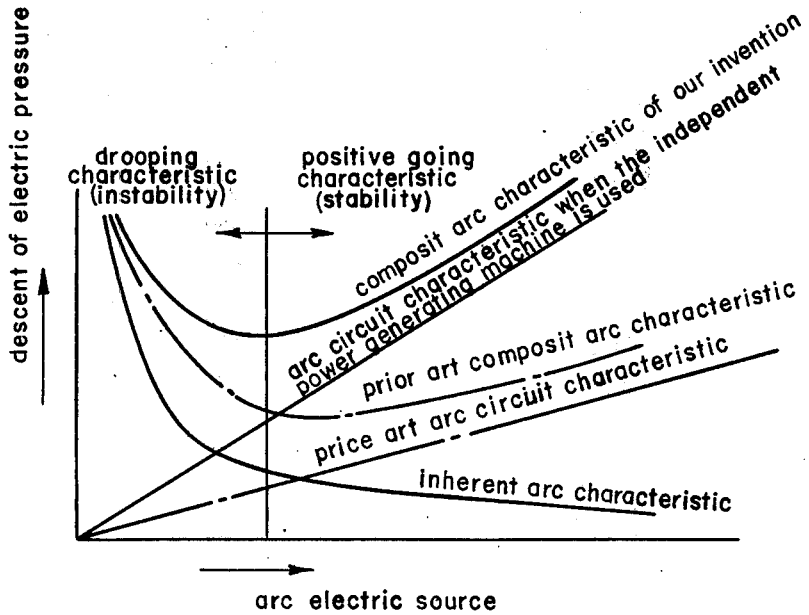
Fig. 4

Fig. 5
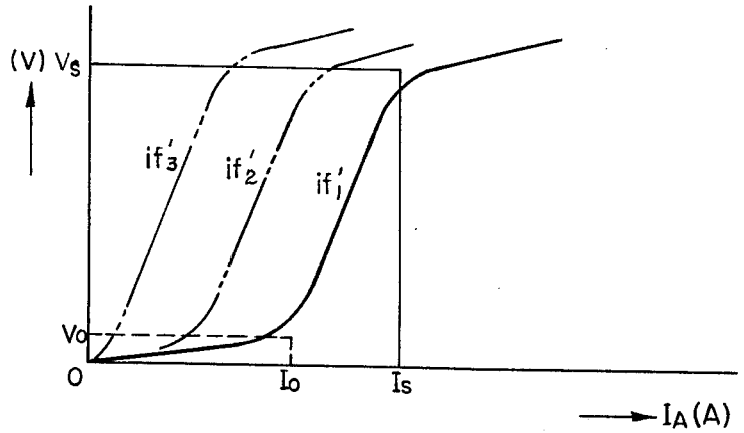
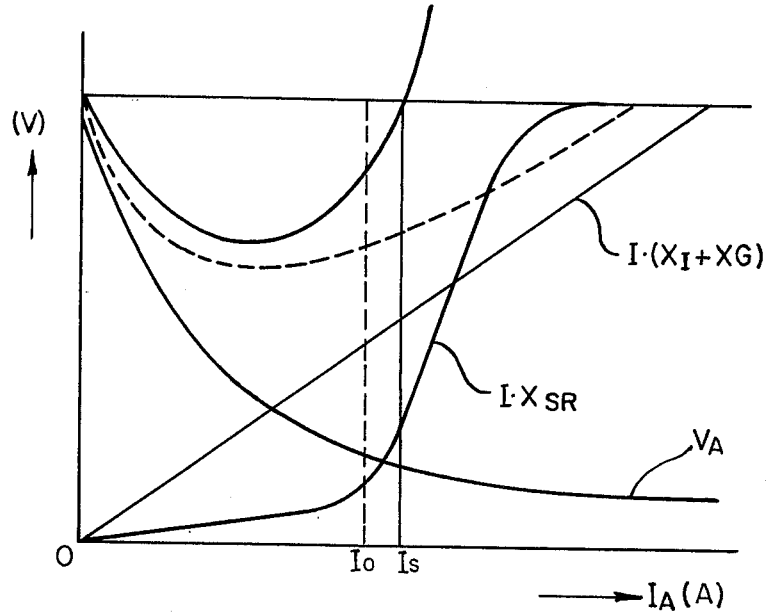
Fig. 6

POWER CONTROL SYSTEM FOR ELECTRIC ARC OR REFINING FURNACE ELECTRICALLY DIRECTLY COUPLED TO INDEPENDENT POWER GENERATING UNIT OR UNITS

DETAILED DESCRIPTION OF THE INVENTION

The present invention relates to generally an electric arc furnace, an electric refining furnace and so on which are supplied with power from an independent power generating unit or units, and more particularly a power control system for an electric arc furnace, an electric refining furnace and so on in order to prevent the adverse effects due to the sudden variation in load of the furnace over such a wide range extending from 0 to 200%, upon other installations, and to attain the considerable improvement of the self-stability of the arc or electric heating load so as to relieve the load of a prime mover in the independent power generating unit, thereby attaining the effective power control for the electric arc or refining furnace depending upon the operating conditions thereof.

In general, an electric arc furnace is supplied with power from a common power supply system which supplies power to other installations, equipment and apparatus such as lighting systems, computers and so on. Therefore the voltage variation or flicker caused by the variation in load of the arc furnace gives the external disturbances to other installations. To overcome this problem economically, there has long been a strong demand for an electric arc or refining furnace installation operating on its own independent power generating unit or units.

In a power supply system including a power generating unit installed independently of a publicly available power system for a mini mill plant including an electric arc furnace, a continuous casting apparatus and a bar mill stand for the continuous production of steel bars or the like from raw materials such as scraps, the load of the arc furnace varies suddenly over a wide range extending from 0 to 200%. Therefore in order to limit the variation in voltage supplied to other apparatus within 5 to 10%, the rating of the generator in the independent power generating unit must be selected to be higher than the power required by the mini mill. As a result the installation cost as well as the power cost are increased so that it is not advantageous in practice to provide a private or independent power supply system for a plant with a very small capacity.

In view of the above, according to the present invention, an electric arc or refining furnace is supplied with power from an independent power generating unit or units installed independently of other power supply systems for other installations, equipments and apparatus. Moreover, the generator voltage and the inherent or fundamental characteristics of an arc furnace may be adjusted in an ideal manner depending upon the operating conditions of the furnace. Furthermore, the operating efficiency of an electric arc furnace may be considerably improved and the reliable and stable operation thereof may be ensured without the increase of the rating or capacity of the independent or private power generating unit.

The present invention will become more apparent from the following description of the preferred embodiments thereof taken in conjunction with the accompanying drawing, but it is to be understood that various modifications may be effected without departing the true spirit of the present invention.

In the drawing,

FIGS. 1, 2 and 3 are schematic diagrams of a first, second and third embodiments of the present invention, respectively, FIG. 4 is a graph illustrating the relation between the arc current and the voltage drop;

FIG. 5 is a graph illustrating the relation between the load current and the voltage drop across the terminals of a saturable reactor used in the present invention; and FIG. 6 is a graph illustrating the load voltage characteristic curves of an electric arc furnace.

Throughout the figures same reference numerals are used to designate similiar parts.

FIRST EMBODIMENT, FIG. 1

Referring first to FIG. 1 illustrating the first embodiment of the present invention, reference numeral 1 denotes a prime mover such as a diesel engine, a gas or steam turbine or the like; 2, a three-phase AC generator mechanically and directly coupled to the prime mover 1 and making up therewith a private or independent power generating unit; 3, an electric arc furnace (that is, an electric heating load); 4, an electrode; 5, an impedance matching arc furnace transformer; 6, an automatic voltage regulator for maintaining a constant generator voltage produced by the generator 2; 7, a detector attached to the arc furnace 3 for detecting the operating conditions thereof; $X_G$, an internal reactance of the generator 2; $i_f$, an exciting current; $X_T$, an internal reactance of the transformer 5; $X_F$, a reactance of the arc furnace 3; $V_O$, the output voltage of the generator 2; $V_E$, a potential applied to the electrode 4; and S, the control signal transmitted from the arc furnace 3.

The optium power regulation of the arc furnace 3 is depending upon the input, the power consumption, the power factor, the rate (°C/min.) of temperature rise at a spot on the furnace wall is opposed relation with the electrode 4, the temperature of molten bath, the electrode current, the voltage across the electrode and ground, and so on. In other words, the operating condition of the arc furnace 3 is detected based upon the above factors or criteria so that the generator voltate $V(=k\Phi n)$ may be regulated by regulating the density flux $\Phi$ by controlling the exciting current $i_f$, which is considerably smaller in magnitude than the generator voltage V. Furthermore, the generator voltage V may be maintained constant by the automatic voltage regulator 6 (which may be of any suitable conventional type). Thus the optimum power control for the arc furnace 3 may be attained by a very simple yet very effective manner. The voltage regulation or adjustment by the transformer 5 is no longer needed so that its maintenance may be eliminated.

In order to attain the optimum arc furnace power supply control, the optimum AC frequency $f$ of the generator voltage must be selected depending upon the load characteristics of the arc furnace 3, the electrical and thermal properties of the electrode 3 and so on. For this purpose, the optimum number of poles $p$ of the generator 2 and the operating speed $n$ of the prime mover 1 must be selected based upon the relation given by $$f = p.n/60$$

within limits which may be compromised with the increase in installation costs of the private power plant and the transformer installation. Thus the inherent and fundamental characteristics of the arc furnace 3 and the electrical and thermal properties of the electrode 4 may be considerably improved for the optimum power supply control of the arc furnace 3 in response to its operating condition.

Since the power generating unit consisting of the prime mover 1 and the generator 2 is installed independently of other power generating or supply units, the rating of the generator 2 may be reduced to the rating only sufficient to meet the arc furnace load. In this case, the internal reactance $X_G$ increases by about 25% and functions as a buffer reactor so that the load of the arc furnace 3 may be stabilized.

SECOND EMBODIMENT, FIG. 2

In the second embodiment shown in FIG. 2, the power supply to each electrode 4 is controlled independently of each other in response to various arc furnace operating conditions. That is, depending upon the relation between the tip of each electrode and the charges such as scrap, which is, in general, not uniformly distributed in the arc furnace 3, the power supply is so controlled as to produce the optimum arcs between the electodes 4 and the charges. Thus the thermal efficiency may be remarkably improved, and the wear and abrasion of refractory members may be minimized with the resultant reduction in number of repairs of linings so that labor-saving may be attained.

Referring still to FIG. 2, the power is supplied to each electrode 4 from an independent power generating unit consisting of the prime mover 1, a single-phase generator 2', and the automatic voltage regulator 6, through the impedance matching arc furnace transformer 5 and a current breaker 8. In response to the control signal from each electrode 4, the exciting current $i_f$ of each generator 2' is controlled to vary, in a stepless manner, the flux density $\Phi$ so that the optimum arc voltage may be applied to each electrode 4. Furthermore, in response to the control signal, the operating speed of each generator 2' is also varied to provide the optimum generator voltage $V$ ( = and frequency $f$ ( $= p.n/60$). Thus the reactance $X = 2\pi fL$ may be controlled in an optimum manner for each electrode 4. That is, in response to the operating or arc condition of each electrode 4, the excitation of each generator 2' (which is of the order or 50 KW) is controlled to control the arc power (which is of the order of 50,000 KW). In other words, the control of the exciting power may control about 1,000 times as much power. As a result, the arc furnace transformer 5 is used only for impedence matching not for the voltage regulation as in the case of the prior art system. Therefore, the arc furnace transformer 5 may be made simple in construction so that its maintenance is not needed.

Next the power control systems of the present invention will be described hereinafter together with the prior art control systems for comparison. According to the present invention, the rating of the generator is made substantially equal to the electric heating or arc load, and the internal reactance $X_G$ of the generator is three to five times as high as that of the prior art system. Therefore, the installation cost is inexpensive as compared with the prior art system. Furthermore, the generator may have an equivalent impedance of about 25 to 30%. As a result, the inherent arc characteristic curve, which is drooping or going negative as shown in FIG. 4, may be modified as to have the positive going characteristic as shown in the same figure as with the case of the prior art control system incorporating a buffer reactor. Therefore, the self-stability may be considerably improved while the variation in load of the generator may be reduced so that the stability in operation of the prime mover may be remarkably improved. The decrease in internal impedance of the generator may be sufficiently and easily compensated by selecting a suitable time constant and by suitably adjusting the exciting current as required without adversely affecting the arc stability.

In the prior art arc furnace, which is dependent upon a publicly available power supply, the frequency $f$ is limited to either 50 or 60 Hz. Moreover, the inductance $L_F$, which determines the reactance $X_F = 2\pi fL_F$ in an arc furnace circuit, is mainly and uniquely dependent upon the geometric arrangements of the secondary windings and the electrodes. Consequently, the reactance randomly varies over a wide range for each electrode. However, according to the present invention, the independent power generating unit is provided for each electrode. The generator voltage $V$ ( $= K.\Phi.n$) is regulated by regulating the flux density $\Phi$, and the operating speed of the prime mover, which is mechanically coupled to the generator, is controlled within a predetermined range in response to the variation in power factor, the electrode potential, the current, the voltage and so on. Thus the optimum reactance of an arc furnace circuit may be obtained so that the arc transmission efficiency may be remarkably improved, the wear of the refractory linings of the arc furnace may be minimized, and the uniform and rapid melting or heat may be attained. Moreover, according to the present invention, the optimum frequency may be selected for the diameter and inherent resistance of each electrode to be used so that the current concentration at the surface of the electrode due to the skin effect may be positively prevented, the effective current rating of the electrode may be increased, the consumption of oxidation of the electrode may be minimized, and the ratio of cost of electrodes to the overall operation cost may be reduced.

Moreover, it should be noted that the frequency conversion system in accordance with the present invention may completely solve the problem of limits due to reactance $X_F$ and the skin effect of the electrodes upon the input to an extraordinarily-large-sized UHP arc furnace to be used in connection with the iron and steel production utilizing the nuclear energy.

THIRD EMBODIMENT, FIG. 3

In the third embodiment shown in FIG. 3, a saturable reactor 10 is placed between the generator 2 and the arc furnace transformer 5, and the furnace condition detector 7 is coupled to the automatic voltage regulator 6 through an automatic regulator such as NAMIC which is adapted to regulate the optimum power in response to the furnace operating conditions. The automatic regulator 11 is connected also to means 12 for automatically controlling the characteristics of the saturable reactor 10. Thus the arc current, which tends to change as a heat proceeds, may be always maintained at a predetermined constant value.

Referring still to FIG. 3, the exciting current of the generator 2 and the DC excitation current for the saturable reactor 10 may be automatically adjusted depending upon the operating conditions of the arc furnace 3, which are detected by the detector 7 so that the reactance $X_{SR}$ of the saturable reactor 10 may be automatically adjusted when the load is short-circuited. Thus, the optimum voltage and current may be produced depending upon the operating conditions of the arc furnace, and the variation in load of the generator 2 may be minimized.

The excitation current $i_f'$ for the saturable reactor 10 is automatically controlled by the automatic regulator 11 in response to the signal from the detector 7. When the arcs are stabilized, the reactance $X_{SR}$ of the saturable reactor 10 is almost 0%, but when the arcs are not stable, the arc current is automatically set so that when the arc current should be in excess of this setting point, the reactance $X_{SR}$ is suddenly increased from 5 to 20%. As a result, the overall reactance of the furnace arc circuit ( = reactance of generator + reactance of saturable reactor) is increased from 70 to 85% so that the variation in arc current may be reduced by more than 20%. This means that the rating of the generator 2 may be reduced by more than 20%. Therefore, the improper combustion in the prime mover 1 may be prevented, the overall stability and reliability of the arc furnace circuit may be ensured, and the maintenance cost may be reduced.

Next referring to FIG. 5, the voltage drop across terminals of the saturable reactor 10 due to the variation in load current will be described hereinafter. For a preset constant current $I_O$, the voltage drop is $V_O$ while the voltage drop for load-short-circuited current $I_S$ is $V_S$. It is readily seen that the voltage drop in the saturable reactor 10 for the present load current $I_O$ is very low so that the efficiency of the arc furnace circuit may be not adversely affected. The voltage drop in the saturable reactor 10 abruptly increases as the load current exceeds the preset point or value. For instance, when the load is short-circuited, the voltage drop jumps to $V_S$ in FIG. 5. When the DC excitation current $i_f'$ of the saturable reactor 10 is increased in the order of $i_{f1}'$, $i_{f2}'$ and $i_{f3}'$ in FIG. 5, the characteristics of the saturable reactor 10 may be matched with the change in setting point of the load current. In other words, the load characteristic curve may be sufficiently stabilized against the vertical characteristic such as arc load due to the current-voltage characteristic of the saturable reactor 10.

The characteristics of the arc furnace circuit of the third embodiment will be described in more detail hereinafter with reference to FIG. 6 illustrating the voltage characteristic curves of the arc furnace load. In FIG. 6, the bold curves show the voltage drop when the saturable reactor 10 is incorporated in the arc furnace circuit while the broken curve shows the voltage drop when a saturable reactor is not incorporated. $V_A$ indicates the arc voltage.

As described hereinbefore, when the saturable reactor 10 is incorporated, the arc voltage drops abruptly as the load current exceeds a preset point. Therefore, the load may be stabilized, and the load-short-circuited current may be limited to 120% depending upon the rating of the saturable reactor 10 so that the breaker may be eliminated.

The advantages of the preset invention may be summarized as follows:

i. Depending upon the operating conditions which in turn are dependent upon the input, the power consumption, the power factor, the electrode voltage, the electrode current, the flow of heat and rate of temperature rise at a spot on the furnace wall in opposed relation with an electrode, and so on, the stepless regulation of the powerful generator voltage $V$ ( $= K.\Phi.n$) is accomplished by the regulation of the flux density $\Phi$ based upon the relations $V = K.\Phi.n$ and $f = p.n/60$. Therefore, the optimum power supply may be attained depending upon the operating conditions of the arc furnace. The fundamental characteristics of the rapid melting and refining processes may be improved. The variation in load may be minimized by more than 20% so that the capacity of the independent power generating unit may be reduced by more than 20%. And the reliable operation may be endured.

ii. The operating speed $n$ of the prime mover and the number of poles of the generator are determined depending upon the operating conditions of the arc furnace so that the rectance $X_F$ on the side of the arc furnace as well as the skin effect of the electrodes may be considerably reduced. For instance, when the frequency $f$ is decreased from 60 Hz to 40 Hz, the reactance may be reduced by about 35%. Thus the arc efficiency as well as the rate of cost of an electrode to the overall arc furnace operation cost may be considerably improved. The frequency $f$ Hz may be controlled by controlling the rotational speed of the prime mover so that the reactance $X_F$ on the side of the arc furnace may be suitably adjusted in response to the variation in operating condition of the arc furnace. This the optimum arc power control may be attained.

iii. Since the arc furnace or variable load is separated from other power supply systems, the flicker may be completely prevented. Since the power source voltage may be permitted to vary over a wide range, the rating of the generator may be made almost equal to the load capacity. Therefore, the installation cost of the power generating unit may be reduced to ⅓ to 1/5 of that of the prior art power generating unit. The variation in load may be stabilized so that the rating of the generator may be decreased. As a result the installation cost and the operation cost of the power generating unit may be reduced.

iv. The internal impedance of the generator serves to stabilize the arc variation so that the load of the prime mover may be reduced and the average input level may be increased with the resultant increase in productivity. That is, the variation in load of the generator may be minimized so that the load may be made uniform, the operation of the prime mover may be stabilized and the adjustment and maintenance thereof may be much facilitated.

v. Because of the reason described in (i), the arc furnace transformer with a voltage regulator may be made simple in construction, thus resulting in the reduction in cost and the elimination of maintenance.

vi. The present invention may be applied not only to the electric arc furnaces for the production of steel from scraps and reduced pellets, the electric refining furnaces, and carbide furnaces but also to the ultra-high-power arc furnaces used in conjunction with the iron and steel production utilizing the nuclear energy.

What is claimed is:

1. A power control system for controlling the power supply to an electric heating load of an electric arc furnace independently of any line source comprising an independent, self-contained power generating unit including a prime mover and generator for furnishing power to said load, means for sensing changes in the operating conditions of said furnace, and means controlled by said sensing means for adjusting the power output of said generator to thereby control the power furnished to said load.

2. A power control system as defined in claim 1 wherein the power control is made by the adjustment of the frequency ( $=p.n/60$ Hz, where $p=$ number of poles of generator and $n=$ operating speed of a prime mover coupled to said generator) depending upon the operating conditions of said furnace.

3. A power control system as defined in claim 1 wherein the power control is made by the adjustment of the generator voltage ( $=K.\Phi.n$, where $K=$ constant, $\Phi$ = flux density and $n$ = operating speed of a prime mover mechanically coupled to each generator) depending upon the operating conditions of said furnace.

4. A power control system as defined in claim 2 wherein the power control is made by suitably selecting the frequency of the generator voltage of the generator depending upon the operating conditions of said furnace.

5. A power control system as defined in claim 3 wherein the power control is made by suitably adjusting the generator voltage of the generator depending upon the operation conditions of said furnace.

6. A power control system as defined in claim 1 wherein a saturable reactor is placed between each independent power generating unit and said electric heating load for the power control depending upon the operating conditions of said furnace.

7. A power control system as defined in claim 6 wherein the power control is made by the suitable selection of the frequency of the generator voltage of the generator depending upon the operation conditions of said furnace.

8.. A power control system as defined in claim 6 wherein the power control is made by the suitable selection of the generator voltage depending upon the operating conditions of said furnace.

9. A power control system as defined in claim 6 wherein the power control is made by the suitable selection of the frequency of the generator voltage of each generator for each electrode in said furnace depending upon the operation conditions thereof.

10. A power control system as defined in claim 6 wherein the power control is made by the suitable selection of the generator voltage of each generator for each electrode in said furnace depending upon the operating conditions thereof.

* * * * *